US005819653A

United States Patent [19]

McCue

[11] Patent Number: 5,819,653

[45] Date of Patent: Oct. 13, 1998

[54] METHOD FOR MAKING A SCREEN PRINTING SCREEN

[76] Inventor: Geoffrey A. McCue, R.R. 3, Box 150, Lawrence, Kans. 66044

[21] Appl. No.: 731,885

[22] Filed: Oct. 22, 1996

[51] Int. Cl.[6] ..... B41C 1/14

[52] U.S. Cl. ..... 101/128.21; 101/128.4

[58] Field of Search ..... 101/128.21, 128.4, 101/401.1; 430/308

[56] References Cited

U.S. PATENT DOCUMENTS

| | | | |
|---|---|---|---|
| 4,003,312 | 1/1977 | Gunther | 101/401.1 |
| 4,291,116 | 9/1981 | Tibbetts | 430/308 |
| 4,718,340 | 1/1988 | Love, III | 101/128.4 |
| 5,154,121 | 10/1992 | Schneider | 101/401.1 |
| 5,156,089 | 10/1992 | McCue et al. | 101/128.4 |
| 5,189,951 | 3/1993 | Webster et al. | 101/128.21 |
| 5,312,654 | 5/1994 | Arimatsu et al. | 347/101 |
| 5,511,477 | 4/1996 | Adler et al. | 101/128.4 |

FOREIGN PATENT DOCUMENTS

| | | | |
|---|---|---|---|
| 590164 | 4/1994 | European Pat. Off. . | |
| 2611597 | 9/1977 | Germany | 101/128.21 |
| 2176630 | 12/1986 | United Kingdom | 101/128.21 |

OTHER PUBLICATIONS

Science & Technology, "Huge, Clunky—And Maybe The Future", *Business Week*, Jul. 22, 1996.

Aquasol–er, Murakami Screen Technical Data Sheet, Murakami Screen U.S.A., Inc., undated.

Epson Stylus Pro Printer, dated May, 1996.

*Primary Examiner*—Stephen R. Funk

*Attorney, Agent, or Firm*—Shook, Hardy & Bacon L.L.P.

[57] ABSTRACT

A method of preparing a screen printing screen is provided whereby a screen with a printing surface is provided, along with a printing mechanism capable of movement in at least two directions. The screen is positioned so that a selected position of the screen is located at a specific reference point. The printing mechanism is then provided with the data which defines an area of the screen which is desired to be blocked with a liquid stencil material. The liquid stencil material is then printed onto the area defined above utilizing the printing mechanism. A barrier coating or a barrier backing may be applied to or against the screen before the liquid stencil material is applied thereto. Thereafter, the stencil coating is applied utilizing the print mechanism and the stencil coating is hardened. After the stencil coating has been hardened, the barrier coating, if used, is removed by spraying the screen with water or air. If the barrier backing is used, it is simply removed after the stencil coating has hardened.

13 Claims, 2 Drawing Sheets

METHOD FOR MAKING A SCREEN PRINTING SCREEN

BACKGROUND OF THE INVENTION

The present invention relates in general to screen printing devices and, more particularly, to a method and apparatus for preparing screens used in such devices.

In typical screen printing processes, ink is applied to a substrate, such as a shirt, poster or decals, through screens which have been prepared in a manner to allow ink to pass through only the desired portions of the screen to form the desired graphic on the substrate. In single, multicolor and four-color process screen printing processes, a separate screen is used for each color of ink which is applied to form the graphic on the substrate. The four-color process differs from multicolor processes in that only four ink colors are used to obtain the desired multi-colored pattern on the substrate.

In most screen printing machines, the screens are clamped on hinged arms which allow the screens to be raised and lowered in relation to the substrate. For example, in manually operated screen printing machines for shirts, the arms which hold the screens are arrayed in a spoke-like fashion and both the screens and the substrate are typically free to rotate to bring successive screens into position over the shirt or other substrate. In automatic screen printing machines, only the substrates rotate, typically in a circular configuration. Each screen is successively positioned over the substrate and is lowered onto the substrate. The ink is then applied through the screen and onto the substrate using a squeegee or pressurized plenum.

Conventional methods for preparing the screens used in screen printing processes have been both time consuming and expensive. One such method involves forming the graphic to be printed as an opaque image on a transparent sheet. Thereafter, an unexposed light-sensitive emulsion or stencil coating is applied to the side of the screen that will contact the substrate to be printed. The graphic on the transparent sheet is then placed over the unexposed emulsion on the area of the screen through which ink flow is desired. The screen is then exposed to a light source which cures or hardens the areas on the screen which are not covered by the graphic on the transparent sheet. The open portions or pores of the screen which are covered with the stencil coating but which are not covered by the graphic on the transparent sheet are fixed in place after the screen is exposed to light. After this exposure to light, the transparent sheet bearing the graphic is removed from the screen and the unexposed stencil coating is removed from the screen by washing the screen with water. Therefore, the portions of the screen that were originally covered with the graphic on the transparent sheet will be open and permeable to the printing ink. At this time, the screen printing screen is ready for use in transferring ink onto the substrate to be printed. This is done by mounting the screen on the screen printing machine and moving the screen into registry over the substrate which is placed on a platen. Ink is then forced through the open pores of the screen onto the underlying substrate.

The above method is disadvantageous in forming a screen printing screen because it can be both expensive and time consuming. This method requires that new artwork, in the form of the transparent sheets, must be formed each time a new graphic is to be printed on an object. Further, in order to ensure the proper orientation of the graphic on the object, the transparent sheet must be properly located or registered with respect to both the printing screen and the printing machine. This problem is accentuated when it is necessary to print a multi-colored graphic on the object which requires a number of different screen printing screens, one for each color in the graphic.

To address the deficiencies in the method described above, another method for preparing a screen printing screen has been developed and is described in U.S. Pat. No. 5,156,089. This method eliminates the need for forming a transparent sheet containing the graphic, but itself contains a number of disadvantages. In this second method, an unexposed light-sensitive emulsion layer or stencil coating is applied to the entire printing surface of a screen as in the previous method. The screen is then placed into an apparatus which prints the graphic directly onto the stencil coating with a liquid ink. In this method, therefore, the applied layer of ink replaces the graphic on the transparent sheet. The printing mechanism is controlled with a computer and prints the graphic dictated by the data provided. After the graphic has been printed on the stencil coating, the stencil coating is cured by exposing it to a light source. The printed graphic acts as an exposure mask or shield so that only the stencil coating which is not covered by the graphic is cured. After the stencil coating has been exposed, the screen is washed to remove the layer of liquid ink and unexposed stencil coating from the screen. Although this method eliminates the need for preparing the graphic on the transparent sheet, it also presents a number of disadvantages.

Utilizing the second method described above requires that the screen be cleaned and degreased prior to beginning the process in order to ensure that the stencil coating properly adheres to the screen. This cleaning and degreasing of the screen adds time and thus expense to the overall process of forming the screen printing screen. Further, it is necessary to ensure that the ink used in forming the graphic is compatible with the underlying light-sensitive stencil coating. Because some commercially available stencil coating materials are incompatible with some commercially available inks, the above process limits the materials that can be used for the coating material and the inks that can be used therewith.

Using the above method also requires that the ink coating placed on top of the stencil coating be sufficiently optically dense to prevent the underlying stencil coating from curing or hardening when exposed to light. If the ink coating is not sufficiently optically dense, the stencil coating under the ink can harden, thus creating an unusable screen printing screen. It is often necessary to apply multiple layers of ink to ensure that a sufficient ink barrier is created so that a usable screen printing screen is created. Providing additional layers of ink on top of the stencil coating adds both time and expense to the process of creating a screen printing screen.

A further disadvantage of the above method results because the ink barrier is applied to only one side of the screen mesh. Because the ink is applied to only one side of the stencil coating, only one side of the stencil coating can thereafter be exposed to light. There is a risk that portions of the opposite side of the stencil coating will be underexposed because the stencil coating, which is typically applied by hand, can vary in thickness. These underexposed portions of the stencil coating can result in certain areas of decreased thickness which can break down during use and allow passage of ink to unintended areas of the substrate. In addition, a partially cured stencil is more difficult to reclaim. In the screen printing business, it is often advantageous to reclaim the screen material when it is no longer necessary to use the stencil that has been applied to the screen. The reclamation process involves using solvents to remove the stencil from the screen. These solvents can actually cause a partially cured stencil to further harden and thus increase the difficulty involved in reclaiming the screen material.

The above described process, and screen printing processes in general, use a polyester fabric for the screen material. This polyester fabric allows light to reflect internally within the fibers. As the light reflects within the fibers and travels along the fibers, it can actually cure portions of the stencil coating lying underneath the applied ink layer. This can result in slightly distorted edges of the stencil as the light cures portions of the stencil that are not intended to be cured. In an effort to reduce the amount of distortion which occurs, different colored meshes or fibers, such as orange or yellow, are used. The use of these different color meshes does reduce the amount of light reflection within the fibers, but also increases the costs of the screen material and thus the cost of the overall process.

Finally, in the above process the stencil coating layer is first applied to the entire screen, which is followed by applying an overlying ink barrier layer to portions of the screen. After curing the stencil coating, the ink barrier layer and the underlying uncured stencil coating are removed by washing the screen with water. However, in washing away the ink barrier and the underlying stencil coating, it has been found that a portion of the cured stencil is washed out as well. This is most often found in the pores of the screen mesh that are only partially filled with the cured stencil coating. As these portions are washed out, the resulting stencil takes on a stepped or saw-toothed appearance. This problem is accentuated when a mesh of a lower density is being used.

Thus, a method and apparatus for preparing a screen printing screen are needed which can overcome the above disadvantages. Specifically, a method for preparing a screen printing screen is needed that will lessen the time needed for preparing such a screen, while at the same time improving the quality of the screen that is made.

SUMMARY OF THE INVENTION

It is therefore an object of the present invention to provide an improved method for making a screen printing screen in which the graphic image is formed directly on the screen by applying the stencil coating around the image, but not in the area of the image, so that the amount of time required to make such a screen is greatly reduced.

It is a further object of the invention to provide a method and apparatus for making a screen printing screen that reduces or eliminates the need to clean and degrease the screen prior to preparation of the screen.

It is another object of this invention to provide a method and apparatus for making a screen printing screen that places the stencil coating onto a screen only in the locations where the stencil coating is desired.

It is a still further object of the present invention to provide a method and apparatus for making a screen printing screen that allows precise control of the thickness of the stencil coating layer applied to the screen mesh so that the coating may be more uniformly cured, thus greatly reducing the opportunity for the coating to break down during use and allow passage of ink to unintended areas of the substrate.

It is still another object of the present invention to provide a method for making a screen printing screen that allows the stencil coating material to be exposed to a light source or other curing medium from both sides of the screen so that the coating may be more rapidly and fully cured.

It is yet another object of this invention to provide a method for preparing a screen printing screen which allows a stencil to be created that has a smooth edge throughout the stencil so that the passage of ink is restricted to only intended areas of the substrate.

According to one aspect of the present invention, the foregoing and other objects are achieved by a method of preparing a screen printing screen whereby a screen with a printing surface is provided, along with a printing mechanism capable of movement in at least two directions. The screen is positioned so that a selected position of the screen is located at a specific reference point. The printing mechanism is then provided with the data which defines an area of the screen that is desired to be blocked with a liquid stencil material. The liquid stencil material is then printed onto the area defined above utilizing the printing mechanism.

In another aspect of the invention, a barrier coating or barrier backing is applied to the screen before the liquid stencil material is applied thereto. Thereafter, the stencil coating is applied utilizing the print mechanism and the stencil coating is hardened. After the stencil coating has been hardened, the barrier coating is removed by spraying the screen with water. If the barrier backing is used, it is simply removed after the stencil coating has hardened.

In still another aspect of the invention, an apparatus for preparing a screen printing screen is provided that has a support surface for the printing screen and a means for locating the printing screen at a given reference location. A printing mechanism is located above the screen that is capable of dispensing a liquid stencil material onto the printing screen. A computer is connected to the printing mechanism that controls the printing mechanism to regulate the location and amount of the liquid stencil material that is dispensed onto the printing screen.

Additional objects, advantages, and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE PREFERRED EMBODIMENTS

Figure 1:
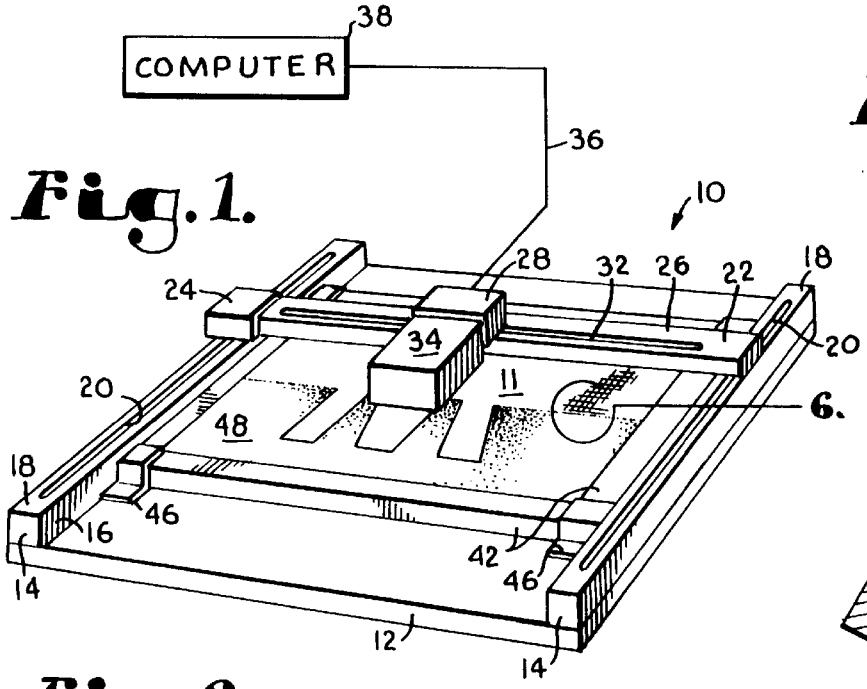
FIG. 1 is a partially schematic perspective view of an apparatus for making a screen printing screen according to the present invention.

Referring now to the drawings in greater detail and initially to FIG. 1, a screen preparation apparatus in accordance with the present invention is represented broadly by the numeral 10. Apparatus 10 is used to apply a stencil coating to selected portions of a screen 11 and includes a flat, generally rectangular base 12 on which the remainder of the apparatus can be securely placed. Disposed on opposite sides of the top surface of base 12 are parallel side rails 14 that preferably are fixed, but may be adjustable inwardly and outwardly on base 12 to accommodate screens of various sizes. Side rails 14 are typically rectangular and each has an inner surface 16 and a top surface 18. Depending into side rails 14 from top surface 18 are slots 20. Slots 20 extend lengthwise along side rails 14 and extend a partial distance downwardly from top surface 18. Slots 20 are used to accommodate a drive mechanism as is more fully described below.

Disposed perpendicularly to side rails 14 is a carriage 22 that is coupled with a carriage motor 24. Carriage 22 is generally rectangular and, along with carriage motor 24, rests on top surface 18 of side rails 14. Protruding downwardly from carriage motor 24 and carriage 22 into slots 20 is a drive pin which is not shown. The drive pin is used to propel carriage 22 back and forth lengthwise along side rails 14. The drive mechanism used to propel carriage 22 can be a cable, belt or rack and pinion system as is well known in the printing art. Thus, carriage motor 24 cooperates with side rails 14 to move carriage 22 lengthwise along the side rails.

Disposed on a riding surface 26 of carriage 22 is a print motor 28. Coupled to print motor 28 is a printing mechanism 34 that extends horizontally outwardly therefrom that contains a quantity of a stencil coating material which is to be applied to a screen as further described below. In one embodiment, print mechanism 34 is a piezoelectric inkjet printing head, such as that found on an EPSON® STYLUS® printer. It will be appreciated that other types of print mechanisms capable of dispensing a liquid material, including a compound inkjet printing head, can be used if desired. In the compound inkjet printing head, the stencil coating material is pushed through a tiny cylinder or barrel by a mechanical plunger or an electrical impulse. Another type of suitable printing mechanism is a deflected continuous flow inkjet head in which a steady stream of the stencil coating material is sprayed, like in an airbrush, but is deflected by a mechanical, electrical or magnetic impulse to correspond with the data provided by the host computer to render the desired image.

Print motor 28 has a drive pin (not shown) that protrudes downwardly into a slot 32 that extends lengthwise along carriage 22 in a manner similar to that described above for carriage motor 24. Specifically, print motor 28, and therefore print mechanism 34, can be moved along carriage 22 through the use of a cable, belt or rack and pinion system as is well known in the art. Slot 32 is capable of accommodating each of these drive systems. Thus, print motor 28 moves itself and print mechanism 34 along the length of carriage 22.

A cable 36 connects print motor 28, print mechanism 34 and carriage motor 24 to a computer 38, shown in schematic fashion in FIG. 1. Computer 38 is responsible for directing the travel of both carriage motor 24 and print motor 28 and is equipped with software to achieve this function, as is well known in the art. Further, computer 38 is responsible for controlling the operation of print mechanism 34 as is more fully described below.

Prior to making a screen printing screen 40, screen 11, which may be a polyester mesh fabric, is first stretched across a frame 42 and is held securely thereto. As can best be seen in FIG. 6, screen 11 is made of individual fibers 44 that are woven together to form screen 11. Further, the individual fibers 44 are woven in spaced apart relation so that open areas or pores 45 are created through which ink will eventually flow onto a substrate. After screen 11 is placed on frame 42, it is placed on top of base 12 between side rails 14 and a set of adjustable braces 46 are placed on base 12 to securely hold frame 42 in place. Braces 46 are typically constructed of metal and can be adjusted on base 12 to accommodate frames 42 of varying sizes.

The above apparatus is used according to the method described below to prepare screen printing screen 40. First, the graphic desired to be printed onto a substrate is designed using the software in computer 38. Thereafter, frame 42, equipped with screen 11, is placed on base 12 and side rails 14 and braces 46 are adjusted to secure frame 42 in place. Print mechanism 34 is then moved to a known reference location on screen 11, such as one of the corners defined by frame 42. This reference location is communicated to and is known by computer 38 which thereafter directs print motor 28 to move across screen 11 along carriage 22. As print motor 28 and print mechanism 34 move across screen 11 along carriage 22, computer 38 further directs print mechanism 34 to dispense a stencil coating 48 onto screen 11 in the areas which are desired to block the flow of ink. Stencil coating 48 may be any number of the stencil coatings which are known in the art, such as: Aquasol-ER available from Murakami Screen U.S.A., Inc. of Montery Park, Calif., which is a PVA-SBQ pure photopolymer direct emulsion; or MAJESTECH MAGI-BLOCK RED® filter available from Majestech Corporation of Somers, New York, which is a water soluble, high solids content filler. In addition, other materials can be used which can be applied to screen 11 in liquid or other form and which can thereafter be hardened to block the flow of ink through screen 11. For example, the 3700 series UV All Purpose Screen Ink available from NazDar of Shawnee, Kans. can be applied in liquid form to screen 11 as described above and can thereafter be cured to form an effective barrier to the flow of ink. Thus, stencil coating 48 coats selected portions of screen 11 by filling in selected portions of pores 45. If a number of layers of stencil coating 48 are desired to be placed on screen 11, computer 38 will direct print motor 28 and print mechanism 34 to move across the same area of screen 11 once again. Print mechanism 34 therefore cooperates with computer 38 to allow a stencil coating to be formed which has the desired thickness. When the desired number of passes have been made, computer 38 directs carriage motor 24 to move carriage 22 a certain distance along side rails 14. Thereafter, computer 38 will direct print motor 28 and print mechanism 34 to move across carriage 22 in the same fashion as discussed above. Thus, computer 38 will direct carriage motor 24, print motor 28 and print mechanism 34 to dispense stencil coating material 48 onto screen 11 in only those areas desired.

Figure 6:
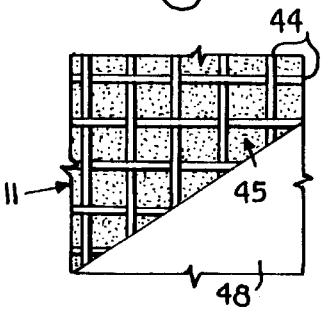
FIG. 6 is an enlarged view of the encircled area in FIG. 1, showing a part of the screen covered by the stencil coating.

As best seen in FIG. 6, the applied stencil coating 48 will cover only those portions of screen 11 that are desired. Importantly, while stencil coating 48 may cover the entire area of an individual pore 45, a fragmentary portion of each pore 45 may also be coated with stencil coating 48. This allows the resulting stencil to have a smooth, well-defined boundary line, as shown in FIG. 6.

Figure 7:
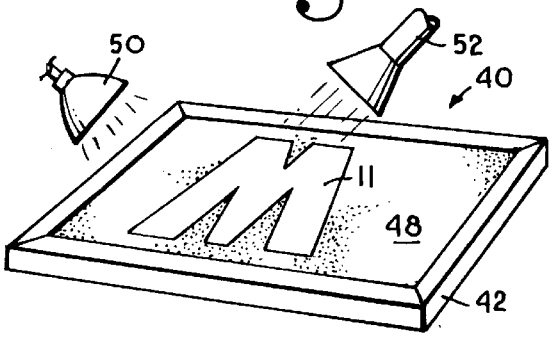
FIG. 7 is a schematic of the screen and frame of FIG. 3, shown after the stencil coating has been applied and depicting exposure of the screen to a light or chemical source.

Computer 38 continues in the above fashion, directing print motor 28 back and forth across carriage 22, and directing print mechanism 34 to dispense stencil coating 48 in the desired area. Further, computer 38 directs carriage motor 24 to advance carriage 22 along side rails 14 until the print mechanism 24 has traveled across the entire surface of screen 11. At this time, only a selected portion of pores 45 will remain uncovered, with stencil coating 48 covering the remainder of screen 11. As best seen in FIG. 7, by covering only selected portions of pores 45, a design can be created on screen 11, such as the letter "M" shown in FIG. 7. Obviously, more complicated designs could be created and coated onto screen 11 with the above apparatus.

After stencil coating 48 has been applied to screen 11, it is exposed to a light source 50 that cures or hardens the stencil coating, as shown in FIG. 7. To ensure that stencil coating 48 is fully and more rapidly cured, both the top and bottom of screen 11 may be exposed to light source 50. Alternatively, depending on the nature of the stencil coating that is used, screen 11 and stencil coating 48 may exposed to a chemical source 52. Chemical source 52 dispenses a chemical onto screen 11 and stencil coating 48 which causes the stencil coating to harden. Once again, both sides of screen 11 may be exposed to chemical source 52 to ensure that stencil coating 48 is fully and more rapidly cured. At this stage, screen 11 is ready for use as a screen printing screen 40. When ink is placed on screen printing screen 40 and forced through pores 45, the graphic will be transferred onto the substrate positioned under screen printing screen 40. In the illustrated case, the letter "M" would be transferred onto the substrate.

Figure 3:
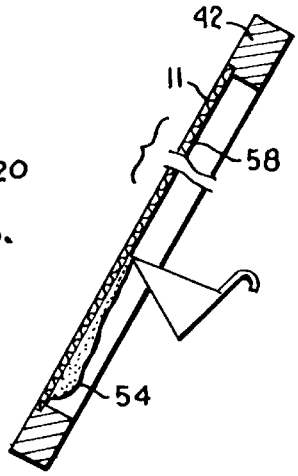
FIG. 3 is a schematic side elevation view of a screen and frame used with the apparatus of FIG. 1, showing a barrier coating being applied to the screen.
Figure 2:
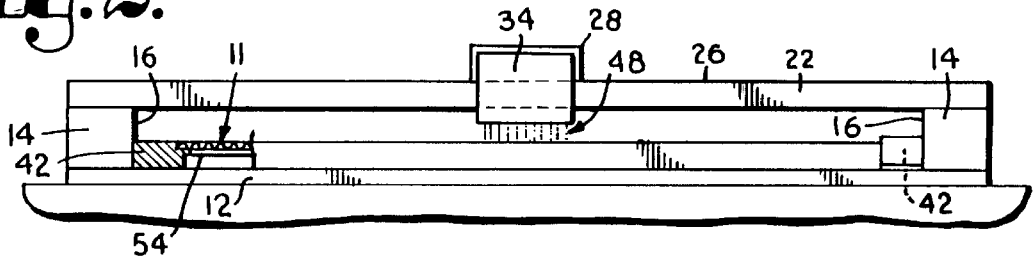
FIG. 2 is a schematic front elevation view of the apparatus of FIG. 1.
Figure 4:
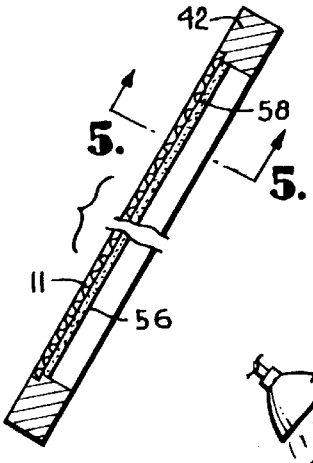
FIG. 4 is a view similar to FIG. 3, showing a barrier sheet applied to the screen.

Depending on the type of screen that is used, it may be necessary to first apply a barrier coating 54 or barrier backing 56 to the underside 58 of screen 11, as best seen in FIGS. 3 and 4. Barrier coating 54 and barrier backing 56 may be necessary if a screen is used that has a low number of fibers 44 per inch. In other words, barrier coating 54 may be necessary if pores 45 are so large that stencil coating 48 will flow easily therethrough. If barrier coating 54 is used, it is applied in any suitable fashion to underside 58 of screen 11, such as by manual application as shown in FIG. 3. Any of various suitable types of substances which will temporarily adhere to screen 11 to effectively block the flow of stencil coating 48 through pores 45 may be used to form the barrier coating. Typically, the barrier coating should be capable of being applied in a liquid, jell, paste or powder form which will then harden when it dries. In one embodiment, barrier coating 54 is an aqueous mixture, such as corn starch and water. Upon drying, barrier coating 54 forms a "filler" or barrier, thus preventing stencil coating 48 from passing through pores 45 of screen 11. Once barrier coating 54 has been applied to screen 11 and is allowed to dry, screen 11 and frame 42 are placed on base 12 and the printing process proceeds as described above. After stencil coating 48 has been printed onto screen 11 in the areas desired, it is cured according to the methods described above. Thereafter barrier coating 54 is washed from the portions of screen 11 that are not coated with stencil coating 48. These areas will wash away easily with water when barrier coating 54 is an aqueous solution because barrier coating 54 will not harden when exposed to light. Alternatively, barrier coating 54 can be removed by a stream of compressed air. Thus, barrier coating 54 ensures that stencil coating 48 will adhere to screen 11 even in those areas where only a portion of an individual pore 45 is desired to be covered, as shown in FIG. 6.

Figure 5:
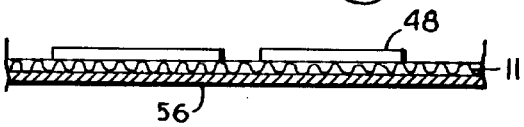
FIG. 5 is a sectional view taken along line 5—5 of FIG. 4, shown after the stencil coating has been applied.

As an alternative to barrier coating 54, a barrier backing 56, as shown in FIGS. 4 and 5 may be placed in contact with the underside 58 of screen 11. Barrier backing 56 can be formed by any material presenting a generally flat surface, such as a sheet of paper, a table top, and the like. Barrier backing 56 operates in the same fashion as does barrier coating 54. Therefore, prior to application of stencil coating 48, barrier backing 56 is brought into contact with the underside 58 of screen 11 and is held in place with any suitable means, such as an adhesive. Stencil coating 48 is then applied to screen 11 in the manner described above and is cured by light source 50 or chemical source 52. Thereafter, barrier backing 56 is removed and screen printing screen 40 is complete. There is no need to further wash screen printing screen 40 when barrier backing 56 is used in place of barrier coating 54.

Therefore, following the curing step, and the removal of barrier coating 54 or barrier backing 56 if necessary, screen 11 and frame 42 are ready for use as a screen printing screen 40. In use, screen printing screen 40 will be placed over the substrate desired to be printed, and ink will be forced through pores 45 which have not been covered by stencil coating 48.

Figure 8:
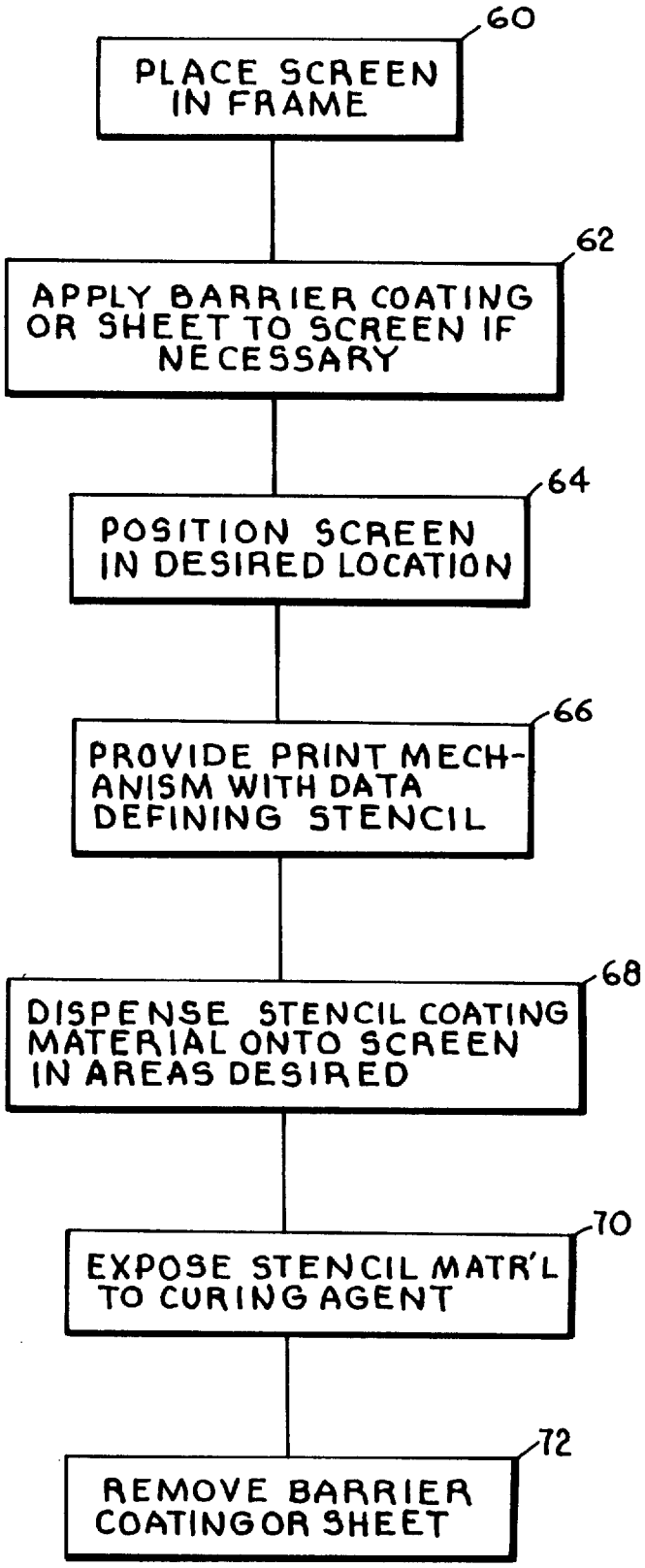
FIG. 8 is a block diagram representing the steps used in the method of the present invention.

As can be seen in FIG. 8, the process of the present invention comprises placing a screen into a frame, as shown in step 60. After the screen has been placed in the frame, a barrier coating or barrier backing is applied to the screen, if necessary, as shown in box 62. The screen and frame are then positioned in the desired location above the substrate to be coated, as represented by box 64. A print mechanism, as shown in box 66, is provided with data which defines the area to be coated with a stencil coating material. The print mechanism is then activated to move across the screen to dispense the stencil coating material onto the desired areas of the screen, as represented in step 68. The screen and the stencil coating material are thereafter exposed to a curing agent, after which time the barrier coating or barrier backing are removed, as shown in boxes 70 and 72, respectively. The above process is thus used to form a screen printing screen in an effective and efficient manner.

As can be seen, the above process overcomes the disadvantages associated with the prior methods of creating screen printing screens. Utilizing this new process, there is no need to clean and degrease the screen prior to creating the screen when a barrier coating or barrier sheet is first applied to the screen. The barrier coating or barrier screen reduces the chances that the stencil coating material will not properly adhere to the screen. Thus, the overall time required to construct a screen printing screen is reduced.

Further, the stencil coating material is applied only to areas of the screen desired to be covered by the stencil. Thus, none of the stencil material is wasted by coating the entire screen and then washing away uncured portions thereof. Instead, only the areas of the screen which are desired to block the flow of ink are coated with the stencil material. While it may be necessary to coat the entire screen with a barrier coating prior to application of the stencil coating material, the barrier coating can be an inexpensive aqueous solution, and is usually less expensive than the stencil coating material. Therefore, by using less stencil coating material 48, the method of the present invention is more cost effective. Further, because stencil coating material 48 is placed only where it is needed, there is no need for an ink barrier coating to block light exposure to undesired areas, which again eliminates the added expense of applying such a layer.

The method of the present invention is additionally advantageous because the applied stencil coating can be exposed to light source 50 or chemical source 52 on both sides of screen 11. In the past method, the entire screen was initially covered with the stencil coating material and an ink barrier coating would be applied prior to curing the stencil coating material. Thus, the screen could be exposed to light on only one side of the screen because the ink barrier would prevent the stencil coating underlying the ink barrier from being exposed only if light was applied on the side of the screen which contained the ink barrier coating. If both sides of the screen were exposed using the past method, the entire screen would be cured, and would thus be unusable. In the present method, however, both sides of the screen can be exposed to light because the stencil coating material is applied to the screen only where it is needed. Thus, because the stencil coating material can be exposed to light on both sides, use of the present invention makes it more probable that the stencil coating material will be fully and rapidly cured. As stated above, a fully cured stencil is more durable and is easier to reclaim.

The method of the present invention also eliminates the concern regarding the optical density of the ink barrier coating. Computer 38 directs carriage motor 24, print motor 28 and print mechanism 34 so that stencil coating 48 is placed on screen 11 only in the desired locations. Thus, there is no need for an ink barrier to prevent certain portions of the stencil coating from hardening. Because there is no need for an ink barrier, there is also no concern over the thickness or optical density of the ink barrier.

An additional advantage achieved with the above method and apparatus is that the concern over light reflection within the polyester fibers of the screen is eliminated. Again, in the prior art method, the stencil coating was placed across the entire screen. Portions of the screen were then covered with a layer of ink and then the screen was exposed to light. Because the entire screen is covered with the stencil coating material, light reflection within the fibers of the screen could cause unwanted portions of the screen to cure or harden. In the past, different colored fibers were used to reduce the problem by reducing the amount of light reflection within the fibers. Screens composed of different colored fibers are, however, more expensive. In the method of the present invention, only those portions of screen 11 on which the stencil is desired are covered with stencil coating material 48. Thus, even if light reflects within fibers 44 of the screen, no unwanted portions of the screen will be cured thereby. Therefore, there is no need to use screen material of a different color, which reduces the cost of the screen and therefore reduces the overall cost of the process.

Finally, the present invention reduces or eliminates the problem of a jagged or saw-toothed edge of the stencil coating that existed in previous systems. Again, in previous systems, the entire screen was coated with the stencil coating material, a layer of ink was applied, the coating was cured, and then the ink and uncured coating material was washed away. The problem arose, however, because the cured stencil coating material often extended across only a portion of an opening in the screen formed by the individual fibers. When the ink layer and underlying uncured stencil coating was washed away, the partially covered portions of the screen opening were often also washed away. This resulted in an undesired jagged stencil edge. The method and apparatus of the present invention eliminate the need for a washing subsequent to the application of the stencil coating material when a screen of sufficient density is used. Even when a barrier coating or barrier sheet is needed in the present invention, the only thing that needs to be washed away is the aqueous barrier coating, which can be a mixture of corn starch and water. Thus, this barrier coating is much easier to wash away than the previous layers of uncured stencil coating material and ink. Because less pressure is required to wash away the aqueous barrier coating, the probability that a portion of the cured stencil material will be washed away in the process is greatly reduced or eliminated. Thus, the resulting screen printing screen will have a smooth edge to the stencil and the resulting image on the product will be of a higher quality.

From the foregoing, it will be seen that this invention is one well adapted to obtain all of the ends and objects hereinabove set forth, together with other advantages which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

It is claimed:

1. A method of preparing a screen printing screen comprising the steps of:

providing a screen having a printing surface;

providing a printing mechanism capable of movement in at least two directions and dispensing a liquid stencil material onto said printing surface of the screen;

positioning said screen so that a selected position of said screen is located at a selected reference point;

providing said printing mechanism with data defining an area of said screen that is desired to be blocked by the liquid stencil material;

applying a barrier material to said screen opposite said printing surface to prevent said liquid stencil material from passing through said screen when applied to the printing surface;

utilizing said printing mechanism to print said liquid stencil material on said area of said printing surface after applying said barrier material to the screen; and removing said barrier material from at least an area of said screen that has not been printed with said liquid stencil material.

2. The method of claim 1, wherein said step of applying a barrier material to said screen comprises applying an aqueous barrier coating to said screen opposite said printing surface.

3. The method of claim 1, wherein said step of applying a barrier material to said screen comprises applying a barrier backing to said screen opposite said printing surface.

4. The method of claim 1, further comprising hardening said liquid stencil material after said liquid stencil material has been applied to said printing surface.

5. The method of claim 4, wherein said hardening is achieved by exposing said liquid stencil material to light.

6. The method of claim 5, wherein both sides of said printing screen are exposed to light.

7. The method of claim 4, wherein said hardening is achieved by exposing said liquid stencil material to ultraviolet light.

8. The method of claim 1, wherein said liquid stencil material is selected from the group consisting of water soluble polyvinyl alcohol resin based liquid, ultraviolet all purpose screen ink, and water-resistant, water-based screen blockout.

9. The method of claim 1, further comprising controlling the thickness of the liquid stencil material that is applied.

10. A method of preparing a screen printing screen comprising the steps of:

providing a screen having a printing surface;

providing a printing mechanism capable of dispensing a liquid stencil material onto said screen;

positioning said screen so that a selected position of said screen is located at a selected reference point;

providing a controller with data defining an area of said screen that is desired to be blocked by said liquid stencil material;

applying a barrier material to said screen opposite said printing surface to prevent said liquid stencil from passing through said screen when applied to the printing surface;

printing said liquid stencil material onto said area of said printing surface utilizing said printing mechanism after applying said barrier material to the screen; and removing said barrier material from at least an area of said screen that has not been printed with said liquid stencil material.

11. The method of claim 10, wherein said step of applying a barrier material to said screen comprises applying a barrier backing to said screen opposite said printing surface.

12. The method of claim 10, further comprising hardening said liquid stencil material after said liquid stencil material has been applied to said printing surface and after said barrier material has been removed.

13. The method of claim 10, wherein said step of applying a barrier material to said screen comprises applying an aqueous barrier coating to said screen opposite said printing surface.

* * * * *